US008360080B2

(12) United States Patent
Liu et al.

(10) Patent No.: US 8,360,080 B2
(45) Date of Patent: Jan. 29, 2013

(54) UMBRELLA

(75) Inventors: Kai Liu, Linhai (CN); Zhonglin Wang, Linhai (CN)

(73) Assignee: Yotrio Group Co., Ltd., Linhai, Zhejiang (CN)

( * ) Notice: Subject to any disclaimer, the term of this patent is extended or adjusted under 35 U.S.C. 154(b) by 9 days.

(21) Appl. No.: 12/595,810

(22) PCT Filed: Apr. 25, 2008

(86) PCT No.: PCT/DE2008/000705

§ 371 (c)(1),
(2), (4) Date: Mar. 29, 2010

(87) PCT Pub. No.: WO2008/135014

PCT Pub. Date: Nov. 13, 2008

(65) Prior Publication Data

US 2010/0192997 A1 Aug. 5, 2010

(30) Foreign Application Priority Data

May 7, 2007 (DE) ..... 10 2007 021 821

(51) Int. Cl.
*A45B 17/00* (2006.01)

(52) U.S. Cl. ..... 135/20.1; 135/20.3

(58) Field of Classification Search ..... 135/20.3, 135/20.1, 21

See application file for complete search history.

(56) References Cited

U.S. PATENT DOCUMENTS

| | | | | |
|---|---|---|---|---|
| 4,674,523 | A * | 6/1987 | Glatz | 135/21 |
| 5,002,081 | A | 3/1991 | Stromeyer | |
| 6,014,980 | A | 1/2000 | Glatz | |
| 6,478,037 | B2 * | 11/2002 | Tung | 135/21 |
| 6,662,815 | B2 * | 12/2003 | Tung | 135/20.1 |
| 6,988,504 | B1 | 1/2006 | Goldwitz | |
| 7,134,442 | B2 * | 11/2006 | Ma | 135/20.1 |
| 7,156,114 | B2 * | 1/2007 | Lo | 135/21 |
| 8,066,021 | B2 * | 11/2011 | Ma | 135/20.1 |
| 2003/0019511 | A1 * | 1/2003 | Liu | 135/20.1 |
| 2003/0192580 | A1 | 10/2003 | Tung | |
| 2009/0151759 | A1 * | 6/2009 | Glatz | 135/20.1 |

FOREIGN PATENT DOCUMENTS

| | | |
|---|---|---|
| DE | 44 07 188 | 12/1994 |
| DE | 103 61 775 | 7/2005 |
| EP | 1 602 297 | 12/2005 |
| EP | 1 731 054 | 12/2006 |

OTHER PUBLICATIONS

International Search Report for International Application No. PCT/DE2008/000705.

International Preliminary Report on Patentability and Written Opinion issued Dec. 7, 2009.

* cited by examiner

*Primary Examiner* — Noah Chandler Hawk

(74) *Attorney, Agent, or Firm* — James Cai; Schein & Cai LLP

(57) ABSTRACT

The invention relates to an umbrella, particularly a sun umbrella or rain umbrella, comprising a holding structure and an umbrella roof attached thereto by means of a joint, the joint being able to be locked by means of a cable or Bowden wire running through at least one part of the holding structure, characterized in that the joint is designed as a purely rotating joint, wherein an engagement element located on the umbrella roof is connected to the cable or Bowden wire or is otherwise mechanically operationally connected thereto, in order to releaseably engage in a segment of the joint associated with the holding structure to lock the joint.

6 Claims, 2 Drawing Sheets

UMBRELLA

BACKGROUND OF THE INVENTION

1. Field of the Invention

This invention relates to an umbrella, in particular a sun umbrella or rain umbrella, with a holding structure and an umbrella canopy suspended on it by means of a joint, where the joint can be locked by means of a cable or Bowden wire which runs through at least a part of the holding structure.

2. Description of Related Art

From the leisure and garden areas, umbrellas of the type under discussion have been known for years. Because of their construction, in which the canopy of the umbrella is suspended on the holding structure, they are also called hanging umbrellas. In these umbrellas the holding structure usually comprises a stand tube curved in the shape of an arc, said stand tube ensuring that the canopy is at a distance in the radial direction from the anchoring of the holding structure on the base. Thus, in the case of hanging umbrellas, the area lying below the canopy can, in an advantageous manner, be completely utilized.

To make it possible to adjust the height of the canopy and to ensure good ability to store the umbrella the holding structure of the umbrella is often implemented to be telescopable so that it can be collapsed or expanded as needed. In the case of other forms of construction the holding structure can be folded up. In both of these cases, due to the jointed suspension of the canopy, a space-saving laying away of the, then expediently folded up, canopy by folding onto the holding structure is made possible. During the use of the umbrella, i.e. during the time spent under the canopy, the jointed suspension of the canopy is, on the contrary, usually not desirable. Since the canopy provides, in the forms of construction being used, a large surface exposed to wind and has a high mass, unintentional tilting movements of the canopy can represent a safety risk.

To solve this problem DE 10 361 775 A1 shows a sun umbrella in which the joint by means of which the canopy is suspended can be locked in its operational state. For this purpose a connecting element (16) projecting upwards (cf. reference numbers in DE 10 361 775 A1) is fastened to the pole carrying the canopy and in said connecting element a guide pin (19) is disposed in the transverse direction. In a connecting piece (5) which is formed so as to be complementary to this and is fastened to the holding structure, elongated holes (18) are formed on both sides of a receiving area and bear the guide pin (19) in a manner such that the plug-in part (16), together with the canopy fastened to it, can be displaced with respect to the connecting piece (5) along a certain path of traverse. Due to a lateral recess provided on the connecting piece (5) the plug-in part (16) can be turned in its lower traversed position by 90° in the clockwise sense. Thereby the canopy can be laid on the holding structure. In its upper traversed position, on the contrary, the plug-in part (16) is blocked in its ability to turn with respect to the connecting piece (5) so that the canopy is locked with respect to the horizontal inclination.

To be seen as disadvantageous in the construction described is the fact that the canopy can only be locked in a single angular position with respect to the holding structure, namely in the state of extension from the connecting piece to the plug-in part. The, as required by the concept, displaceable mounting in the elongated holes furthermore requires a greater height of the holding structure in order to achieve a height of the canopy equal to that in the conventional mode of construction. Finally, the described construction requires that to lock the joint the entire canopy be lifted by means of the cable or Bowden wire. Due to this particularly strong forces act on the cable or Bowden wire.

It is thus the object of the present invention to develop and extend an umbrella of the type under discussion in a manner such that the canopy can be locked in different tilting positions, i.e. different angular positions of the joint. Furthermore, the umbrella should have a low height and the force to be applied by the cable or Bowden wire for locking should be reduced with respect to that applied in the case of known umbrellas.

SUMMARY OF VARIOUS EMBODIMENTS

According to the invention the object above is realized by the features of claim 1. According to these the umbrella under discussion is characterized by the fact that the joint is implemented as a pivotable joint for setting an arbitrary inclination of the canopy, where an engagement element disposed on the canopy is connected to the cable or Bowden wire, or is in some other active mechanical connection with it, in order to engage, in a manner such that it can be released, in one of the joint's sections associated with the holding structure in order to lock the joint.

In a manner according to the invention it has first been recognized that the practical utility of the umbrella can be increased if the canopy, e.g. for adaptation to different positions of the sun, for adaptation to inclined ground, or the like, can be brought into different angular positions with respect to its inclination relative to the horizontal plane and can be locked there. This aim is achieved in a manner according to the invention first by the fact that, instead of a joint which can be displaced, pivoted, and locked in a position, a purely pivotable joint is used, which represents a simplification in construction. To realize the concept of the invention it can be a pivot joint with one degree of freedom or a spherical joint with two degrees of freedom.

In a further manner according to the invention a technically convenient realization of the intended locking of the canopy in a desired angular position has been found. For this, an engagement element disposed on the canopy is connected to, or is in some other active mechanical connection with, the cable or Bowden wire in order to engage, in a manner such that it can be released, in one of the joint's sections associated with the holding structure in order to lock the joint. In connection with this, the engagement element on the canopy is preferably disposed in a manner such that it can be displaced and/or pivoted.

The actuation of the engagement element by means of the cable or Bowden wire for locking the joint can be realized according to the invention in different ways. In the simplest case the cable or Bowden wire is connected directly to the engagement element so that a tensile force acting on the cable or Bowden wire directly sets the engagement element in motion. Alternatively to a direct connection of the cable or Bowden wire to the engagement element the cable or Bowden wire can, also in a manner according to the invention, be in some other active mechanical connection with the engagement element. Different mechanical transmission devices are conceivable in connection with this. A preferred possibility of embodiment will be explained in the later course of the description.

In a further manner according to the invention the engagement element engages, in a manner such that it can be released, in one of the joint's sections associated with the holding structure in order to lock the joint. For this, this section of the joint expediently has a suitable surface profile, or some other suitable shape, to ensure, working together with the engagement element acting thereon, a hold which is sufficient to lock the joint in different angular positions.

In an advantageous extension of the invention the joint's part associated with the holding structure comprises a joint head in whose head surface the engagement element engages in a manner such that it can be released. The configuration as a joint head, i.e. with an at least locally round or arched surface (head surface), ensures that the engagement section working together with the engagement element has a constant spacing from the axis of the joint. This engagement section, the head surface of the joint head, can then, for example, be toothed or have some other suitable profiling.

In one of the umbrella's implementations which is advantageous from the standpoint of construction the joint comprises a joint axle which, for example, can be implemented as a pin, bolt, screw, or the like, where the joint axle connects one of the joint's parts associated with the holding structure to one of the joint's parts associated with the canopy. To achieve the intended tilting of the canopy the joint axle can be aligned approximately perpendicular to the horizontal plane. In this implementation the joint is a pivot joint with one degree of freedom. Let it be pointed out that a different alignment of the joint axle is also conceivable. Furthermore, the joint can alternatively be implemented as a spherical joint.

An additional advantageous configuration of the umbrella can be achieved if the joint is formed to be hollow for guiding the cable or Bowden wire through. In this case the cable or Bowden wire does not run merely through at least a part of the holding structure but rather can even run through the joint up into the canopy. For this the legs of the joint are expediently implemented at least partially as tubes and the joint lying therebetween, e.g. the joint head, also comprises a corresponding passageway.

With regard to construction it can be practical if the joint's part associated with the canopy forms the pole of the canopy or is connected to the pole of the canopy. In that case the pole of the umbrella serves as the central receiver for additional components of the canopy. To obtain a component which is resistant to bending stress and at the same time is light, the pole can be a tube, preferably with a round cross section. The pole can be implemented as an integral part of the joint or as a part separate from the joint, where that part is then connected to the joint, for example, screwed on, glued on, riveted on, or the like.

The engagement element's movement required for locking of the joint in such a manner that is can be released can be achieved conveniently if the engagement element is disposed, in a manner such that it can be displaced, in the joint's part associated with the canopy, in particular in the pole. The locking movement of the engagement element is then purely translational, and in fact expediently in the radial direction with respect to the joint axle. Alternatively, the engagement element can also be disposed, in such a manner that it can pivot, on the joint's part associated with the canopy, which can be practical independently of the form of construction of the canopy.

A further advantageous development results if the engagement element comprises a passageway for the cable or Bowden wire. A configuration of this type has the effect that the tensile forces proceeding from the cable or Bowden wire can act on the engagement element at its center. For this the cable or Bowden wire can be fastened directly to the engagement element and/or run through it in order to work together with additional mechanical functional elements.

In an additional advantageous manner the engagement element is disposed on the joint-side end of a sleeve extending in the axial direction, at least partially, through the pole or can be implemented as an integral part of a sleeve extending in the axial direction through the pole. This sleeve, which together with the engagement element can be displaced with respect to the pole, for one thing ensures a secure mounting of the engagement element and for another makes possible the guiding through of the cable or Bowden wire also into additional functional elements mounted following the engagement element.

Since, for the most part, tensile forces can be transmitted through the cable or Bowden wire it can be expedient to provide, by means of an elastic element, such as, for example, a spring, for the engagement element's movement against the restoring force of this spring but required for the locking of the joint.

In this connection the spring can be formed, in an advantageous extension, as a helical spring which is disposed around the engagement element or around an element connected to it, in particular the sleeve. The helical spring is then supported, for example, against a shoulder of the sleeve and a shoulder of the pole in order to come under tension during the displacement of the engagement element.

The convenience and the possibilities for use of the umbrella are further increased if the canopy is implemented so that it can be opened and closed. A quite particular convenience follows for the user if, along with the joint's locking according to the invention, also the opening and closing of the canopy can be actuated with the cable or Bowden wire.

A technically advantageous construction of an umbrella canopy results if the same comprises a canopy frame which can be collapsed by folding or pushing, where on said canopy preferably a cloth covering is secured. The canopy frame can in principle be any structure forming a canopy skeleton, where said structure can be opened and closed by folding and/or pushing or in some other way. The cloth covering secured on it will expediently consist of a flexible, flat material such as, for example, a natural or artificial textile, a foil, or the like.

In a preferred extension of the umbrella the canopy frame comprises a top hub to which are linked the ribs of the umbrella which open the canopy and the canopy frame also comprises, disposed under its top hub, a runner hub to which stretcher elements are linked. In connection with this each of the stretcher elements is connected at its end opposite the runner hub to a rib of the canopy in a section at a distance from the top hub. In this construction, known per se, of the canopy frame the canopy can be opened or closed by lifting or lowering the runner hub.

In an advantageous manner for a canopy construction which is of this type, or a comparable type, the cable or Bowden wire is linked to the runner hub or a traversing element disposed on it for the application of a tensile force which is directed towards the top hub and opens the canopy. In this way the result is achieved that by means of the cable or Bowden wire not only is the joint locked but rather the canopy can also be opened and, by detensioning the cable or Bowden wire, closed.

In a quite particularly advantageous form of embodiment the previously mentioned sleeve is of a length such that the runner hub or an element disposed on it, such as, in given cases, the traversing element, at the end of the process of opening the canopy strikes the sleeve in order to bring the engagement element into locking engagement with the joint head. In this case the cable or Bowden wire therefore does not need to be directly connected to the engagement element but rather merely linked to the runner hub or a traversing element disposed on it. By pulling the cable or Bowden wire the runner hub is moved, with concomitant opening of the canopy, in the direction of the top hub and, after traversing a certain length, strikes the sleeve, whereby, with an additional exertion of the tensile force, said sleeve, together with the engagement element connected to it, is displaced. Through this mechanical action of the runner hub on the engagement element the intended locking of the joint is achieved.

To achieve a gentle, low-wear contact of the runner hub with the sleeve it can be advantageous to dispose a contact element on the sleeve's end facing the runner hub, where this contact element can be made of a damping material such as rubber, plastic, or the like and/or where this contact element can comprise a suitable bearing surface for the runner hub.

With regard to the implementation of the top hub or the runner hub, different forms of construction are conceivable. A configuration which is simple from the standpoint of construction but advantageous is provided if the top hub and the runner hub are formed as essentially annular bodies, or only one of the top hub and the runner hub is formed as an essentially annular body. The cable or Bowden wire can then, in given cases, run through the top hub or the runner hub and the ribs which open the canopy and the stretcher elements which support these ribs can be linked to the annular circumference of the top hub or the runner hub.

BRIEF DESCRIPTION OF THE SEVERAL VIEWS OF THE DRAWINGS

There are various possibilities for developing and extending the teaching of the present invention in an advantageous manner. In relation to this, on the one hand, we refer to the claims subordinate to claim 1 and, on the other hand, to the following explanation of a preferred embodiment example of the invention with the aid of the drawings. In connection with the drawing of the preferred embodiment example of the invention, developments and extensions of the teaching which are preferred in general are also explained with the aid of the drawings.

DETAILED DESCRIPTION

Figure 1:
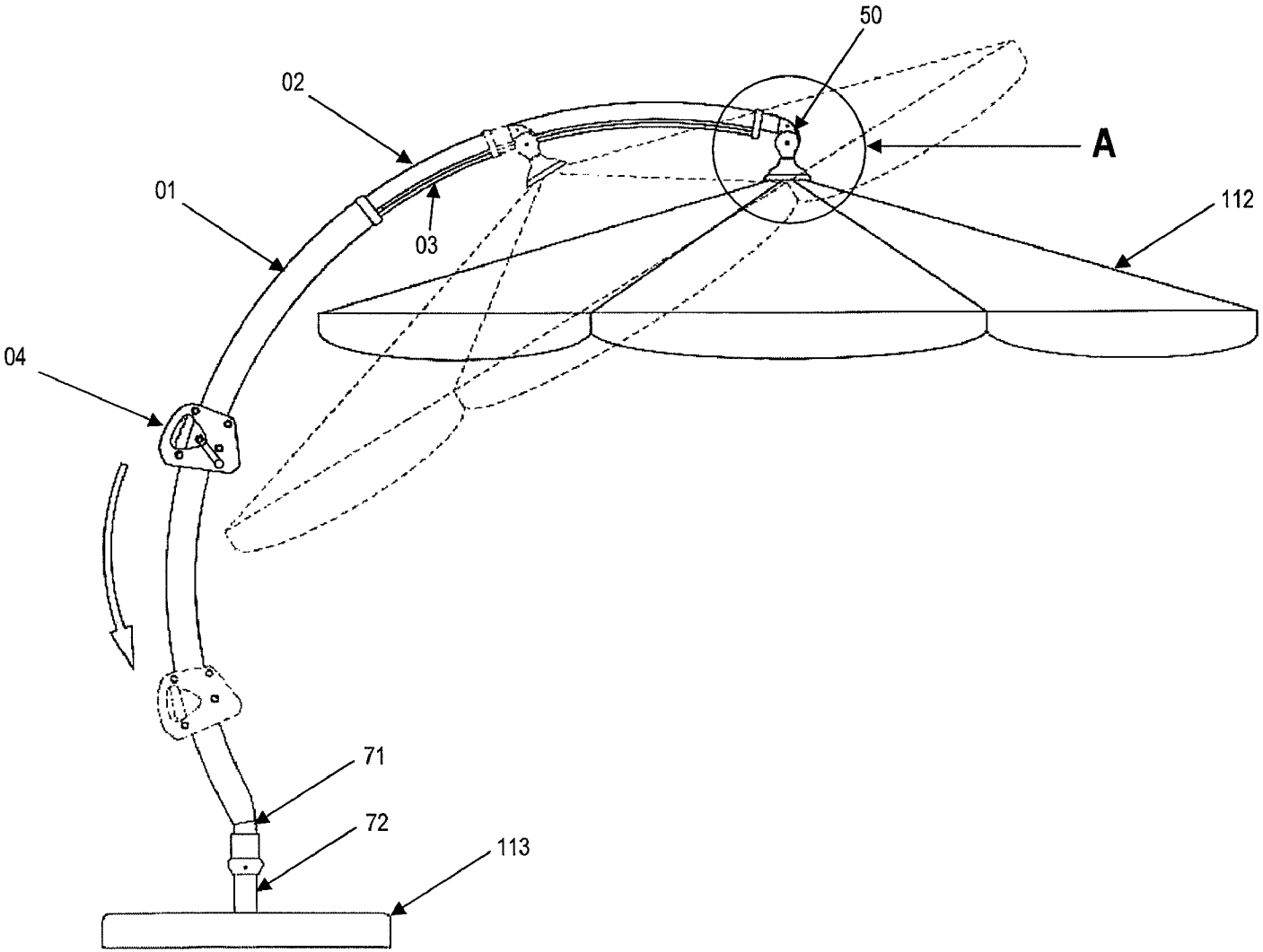
FIG. 1 shows an overall view of an embodiment example of the umbrella according to the invention and FIG. 2 shows a cross-sectional view of the detail A from FIG. 1.

FIG. 1 shows in side view an embodiment example of an umbrella according to the invention. The umbrella represented is a hanging umbrella in which the canopy 112 is set at a distance in the radial direction from the foot 113 of the stand by means of the arched holding structure. The holding structure comprises essentially a receiving tube 01 which is curved in the shape of a circular arc and in which a telescoping tube 02, also curved in the shape of a circular arc, is disposed in such a manner that it can be displaced and locked. The receiving tube 01 is fixedly connected to the tiltable pole 71 which serves as an intermediate piece and is mounted in a manner such that it can tilt (in the horizontal plane) with respect to the stand pole 72. The stand pole 72 is in turn fixedly connected to the foot 113 of the stand. The canopy 112 is suspended by means of a joint 50 to the upper end of the telescoping tube 02, that is, the end facing the canopy 112.

A supporting tube 03 is disposed parallel to the telescoping tube 02 and is connected to the telescoping tube 02 at an end of the supporting tube 03, specifically the end facing the canopy 112. Since the supporting tube 03 is also mounted in such a manner that it can be displaced with respect to the receiving tube 01, the canopy 112 can be brought into different positions by pushing the telescope in or pulling it out, for example, for adapting to different positions of the sun or for storing the umbrella. To do this the user grabs the hand grip 04 which is connected, through a (not represented) slot-like opening in the receiving tube 01, to the telescoping tube 02 and/or to the supporting tube 03 in order to bring the telescope from a pushed-in state (represented by dotted lines) into a pulled-out state (represented by solid lines). As is to be inferred from the representation, the joint 50 is locked here so that the canopy 112 is at the same angle relative to the telescoping tube 02 independently of the extent to which the telescope is pushed in.

In the hand grip 04 a cable winch, not to be seen here, is disposed within the receiving tube 01. The cable winch can be actuated via a hand crank disposed on the hand grip 04 and projecting out of it. One end of a cable 111 (not to be seen in FIG. 1) is wound onto the cable winch, where the remaining part of the cable 111 runs from the cable winch through the telescoping tube 02 and the joint 50 into the canopy 112. By actuating the crank the cable 111 is tightened and untightened, whereby the canopy 112 can be opened and closed. By actuating the crank the canopy 112 can furthermore be locked in different angular settings with respect to the telescoping tube 02. The suspension of the canopy 112 coming into use in so doing is represented in FIG. 2.

Figure 2:
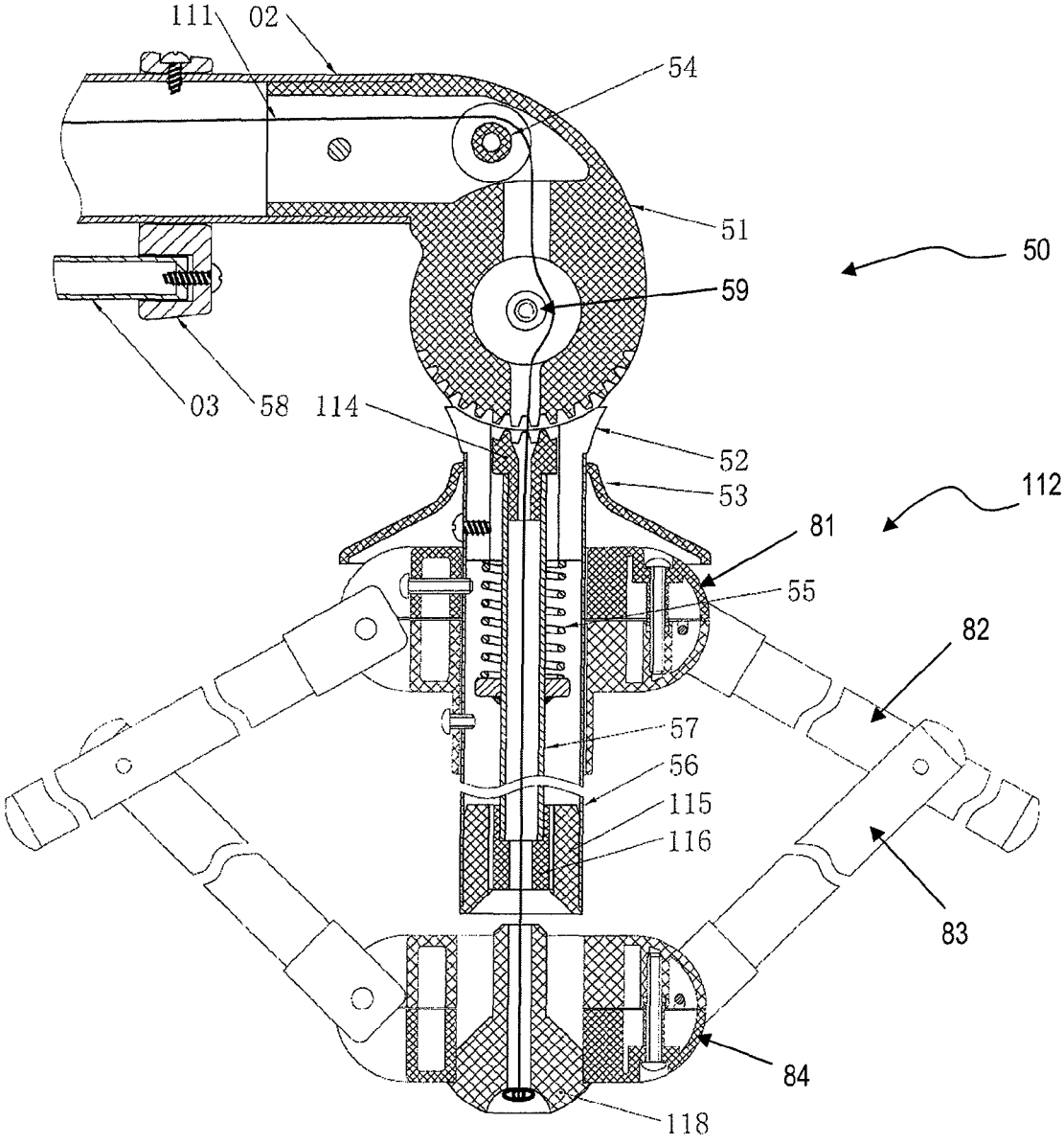

FIG. 2 shows in cross section the umbrella's area encircled as detail A in FIG. 1. There it can be seen that the canopy 112 is suspended by means of a joint 50 on the holding structure of the umbrella, here the end section of the telescoping tube 02. The joint 50 comprises essentially a joint head 51, a joint axle 59, and the pole 56 connected to the joint head 51 by means of the joint axle 59. The pole 56 is implemented as a sleeve made of aluminum and can basically, i.e. in the unlocked state, be freely tilted with respect to the joint head 51 around the joint axle 59, whereby the entire canopy 112 fastened to the pole 56 is tilted. Due to the basically freely tiltable suspension the canopy 112 can be brought into different angular positions relative to the horizontal plane, whereby, for example, an inclination of the ground at the setup site can be compensated, an adaptation to different positions of the sun can be made, or the canopy, in the unused state, can be laid on the telescoping tube for storage.

As can be inferred from FIG. 2, the cable 111, which is formed as steel cable here, runs through a part of the holding structure, here the telescoping tube 02, is then deflected, by a deflecting roller 54 disposed in the joint head 51, from an axial direction (here horizontal) into a radial direction (here vertical), and then runs through the joint head 51, past the joint axle 59, through the engagement element 114 and the sleeve 57, into the traversing element 118, and is finally secured with respect to this by an end piece. The traversing element 118 has approximately the shape of an inverted mushroom, where the head of the traversing element 118 is larger than the passageway formed for the traversing element 118 in the runner hub 84.

A tensile force acting on the cable 111 and directed upwards by the deflection performed thus causes a lifting of the traversing element 118 together with runner hub 84. The stretcher elements 83 linked in the radial direction to the runner hub 84 are hingedly connected to ribs 82 connected to the top hub 81 so that lifting the runner hub 84 opens the frame of the canopy 112.

The joint head 51 is plugged with a tongue-like section into the upper end of the telescoping tube 02. The downwardly pointing head surface of the joint head 51 is formed as an engagement surface for the engagement element 114. For this a toothing which is approximately the same as a circumferential section of a toothed wheel is formed on the engagement surface.

The engagement element 114 fastened to the sleeve 57 comprises an engagement section formed to be complementary to the engagement surface of the joint head 51, whereby the engagement element 114, in the engaged state, holds the canopy 112 in a desired angular position with respect to the joint head 51. On the sleeve 57, in its center area, a shoulder is formed by which a helical spring 55 disposed around the sleeve 57 is held in the axial direction. The helical spring 55 is supported at its opposite end against the molded part 52 connected to the pole 56 so that the sleeve 57 together with the engagement element 114 is pressed out of the engaged state by the restoring force of the spring 55.

Due to the opening of the umbrella and, caused thereby, the lifting movement of the traversing element 118, said traversing element, at the end of the opening process, strikes the contact element 116 disposed at the lower end of the sleeve. On further exertion of the tensile force by means of the cable 111 this striking causes the spring force of the helical spring 55 to be overcome and the sleeve 57 pushes the engagement element 114 into the engaged state. Thereby it is ensured that the joint 50 is locked in the opened state of the canopy 112.

In FIG. 2 it is furthermore to be seen that a cap-like covering 53 for the top hub 81 is provided in order to prevent the penetration of dirt or water into the mechanism of the canopy 112. The top hub 81 and the runner hub 84 are implemented as annular bodies which are divided in the radial plane.

With regard to additional advantageous developments of the umbrella according to the invention, to avoid repetition reference is made to the general part of the description and to the accompanying claims.

Finally, let it be expressly pointed out that the above-described embodiment example of the umbrella according to the invention serves only for the discussion of the claimed teaching but does not restrict it to the embodiment example.

The invention claimed is:

1. An umbrella comprising:

a foot (113), said foot having a lower end and an upper end;

a stand pole (72), said stand pole having a lower end and an upper end, said lower end of said stand pole (72) connected to said upper end of said foot (72);

a tiltable pole (71), said tiltable pole (71) having a lower end and an upper end, said lower end of said tiltable pole (71) connected to said upper end of said stand pole (72);

a curved receiving tube (01) attached at its bottom end to the top of the tiltable pole (71), said tiltable pole (71) forming an intermediate piece between the curved receiving tube (01) and the stand pole (72), wherein the tiltable pole (71) is configured to tilt in a horizontal plane with respect to the stand pole (72);

a telescoping tube (02) having an arch to it that allows it to be disposed inside the curved receiving tube (01) and to slip between an extended a pulled-out state and a collapsed pushed-in state, wherein a distal end of the telescoping tube (02) will follow such arch and change its angle relative to the foot (113):

a supporting tube (03) attached (58) to an inside radius of the telescoping tube (02) and able to slip inside the curved receiving tube (01) while providing for lateral stability;

a lockable joint (50) mounted to said distal end of the telescoping tube (02) that provides a point of suspension for a foldable umbrella canopy (112), wherein if locked and if umbrella canopy (112) is unfolded, the tilt of the umbrella canopy (112) relative to the foot (113) depends on the extent to which the telescoping tube (02) inside the curved receiving tube (01) has been slipped between said extended pulled-out state and said collapsed pushed-in state, and wherein said lockable joint (50) is configured to provide a freely tiltable suspension of the umbrella canopy (112) with respect to the telescoping tube (20), said lockable joint comprising:

a joint head (51) and a pole (56) connected together by a joint axle (59), said joint head (51) comprising a toothed wheel defined at a circumferential section of an engagement surface of the joint head (51), and wherein the pole (56) can be locked to the joint head (51) at different angles or released to pivot through a range of angles;

a repositionable and releasable engagement element (114) disposed inside the pole (56) and comprising a plurality of teeth, said teeth of said engagement element (114) configured to complement the toothed wheel of said joint head (51), said toothed wheel of said joint head (51) configured to engage said teeth of said engagement element (114) in a pawl-type engagement for locking the pole (56) with the joint head (51) at said different angles, said engagement element (114) comprising an elongated sleeve (57) disposed within said pole (56), said sleeve (57) being concentric to said pole (56);

a spring (55) disposed around the sleeve (57), said spring being supported at one end by a molded part (52) of the pole (56) to press out the sleeve (57) together with said teeth of said engagement element (114) out of an engaged state with said teeth of said joint head (51) by a restoring force of the spring (55), wherein said disengaged sleeve (57) and said engagement element (114) configured to pivot through said range of angles with respect to the joint head (51);

a cable (111) traversing through said telescopic tube (02), said cable (111) being deflected by a deflecting roller (54) disposed in the joint head (51) to change direction of traverse of said cable (111) from a horizontal direction into a vertical direction, wherein one end of said cable (111) traversing in said vertical direction passes through the joint head (51), the joint axle (59), the engagement element (114), and the sleeve (57) to securely connect with a traversing element (118); and said cable (111) configured to lift the traversing element (118) when said deflecting roller (54) deflects a tensile force acting on the end of the cable (111) in the telescoping tube (02) in an upward direction, said traversing element (118) configured to strike the lower end of the sleeve (57) on further exertion of said tensile force on said traversing element (118) by said cable (111), said traversing element (118) configured to overcome the spring force of the spring (55) on continued exertion of said tensile force on said traversing element (118) by said cable (111) and cause the sleeve (57) to push the engagement element (114) into the engaged state, wherein said teeth of said engagement element (114) engages said toothed wheel of said joint head (51) in said pawl-type engagement;

a hand grip (04) and crank which travel relative to the curved receiving tube (01) with the movements of telescoping tube (02), said other end of said cable (111) being wound to the crank and that provides said cable (111) to control the locking and releasing of lockable joint (50) and the folding and unfolding of umbrella canopy (112).

2. The umbrella of claim 1, wherein the spring (55) is a helical spring disposed around the engagement element (114) and the sleeve (57).

3. The umbrella of claim 1, wherein the canopy includes a frame comprising a top hub (81) and runner hub (84) defined as annular bodies divided in a radial plane and attached to the pole (56), and a plurality of stretcher elements (83) individually linked to canopy ribs (82) and all configured to allow the umbrella canopy (112) to be opened and closed under control of cable (111).

4. The umbrella of claim 1, wherein the canopy (112) comprises a canopy frame configured to be collapsed by folding or pushing and that has a cloth covering;

wherein, the canopy frame has a top hub (81) to which are linked umbrella ribs (82), a runner hub (84) on the pole (56) and to which stretcher elements (83) are connected such that the canopy frame and canopy (112) can be opened or closed by lifting or lowering the runner hub (84) along the pole (56) under control of the cable (111).

5. The umbrella of claim 4, wherein the pole (56) is operably positioned through the top hub (81), wherein in an unlocked state, the pole (56) is configured to freely tilt with respect to the joint head (51) around the joint axle (59), and wherein the pole (56) is of a length such that the runner hub (84) and a traversing element (118) press the engagement element (114) to lock with the joint head (51) at the end of their travel when opening the canopy (112).

6. The umbrella of claim 4, wherein a contact element (116) is disposed on an end of the pole (56) facing the runner hub (84) and comprises a damping material and bearing surface for the runner hub (84).

* * * * *